United States Patent [19]

Butler

[11] Patent Number: 4,767,011

[45] Date of Patent: Aug. 30, 1988

[54] EARRING HOLDER

[75] Inventor: Susan M. Butler, Neptune Beach, Fla.

[73] Assignees: Anna M. Johnson; Floyd T. Johnson, ; a part interest to each

[21] Appl. No.: 86,154

[22] Filed: Aug. 17, 1987

[51] Int. Cl.[4] ..... A47F 7/00

[52] U.S. Cl. ..... 211/13; 211/60.1; 206/486; 206/566

[58] Field of Search ..... 211/13, 69.1, 60.1, 211/163, 199, 96; 206/486, 487, 566; 40/102

[56] References Cited

U.S. PATENT DOCUMENTS

| | | | |
|---|---|---|---|
| 2,193,727 | 3/1940 | Jouffray | 211/60.1 X |
| 3,608,740 | 9/1971 | Bowman, Jr. | 211/96 |
| 3,957,159 | 5/1976 | Radek | 211/131 X |
| 4,420,084 | 12/1983 | Whelan | 211/13 X |
| 4,606,458 | 8/1986 | LaBate | 206/566 |

*Primary Examiner*—Reinaldo P. Machado
*Assistant Examiner*—Sarah A. Lechok Eley
*Attorney, Agent, or Firm*—Arthur G. Yeager

[57] ABSTRACT

An enclosed frame with a loosely stretched flexible mesh material across the frame opening for attaching earrings thereto.

12 Claims, 4 Drawing Sheets

EARRING HOLDER

BACKGROUND OF THE INVENTION

Earrings are not easily stored in any organized fashion because of their small size and odd shapes, and the fact that they are used in pairs. The usual storage is accomplished by simply keeping them loose in a box or drawer, with the result that it is difficult to find a matching pair.

Display racks found in retails stores usually involve displaying small cards or boxes in which are fastened a single pair of earrings in a manner such that the earrings are not readily detachable. As such, these racks are totally unsuitable for use in the home where one wants to quickly find and remove from storage a selected pair of earrings. Insofar as is known, there is no such storage rack available at the present time, nor has one been disclosed in the prior art.

It is an object of this invention to provide an improved holder for earrings for use in the home. It is another object to provide a holder for earrings in which the earrings are easily pinned to a fabric. Still other objects will become apparent from the more detailed description which follows.

BRIEF SUMMARY OF THE INVENTION

This invention relates to an earring holder comprising a frame surrounding a central area of loosely stretched fabric screen material.

In more specific embodiments the fabric is held in the frame with a sag such that over a span of L the fabric has a deflection D at the middle of the span in the proportion D:L is 1:15 to 1:25. Preferably the mesh size of the fabric is about 8–16 openings per linear inch.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
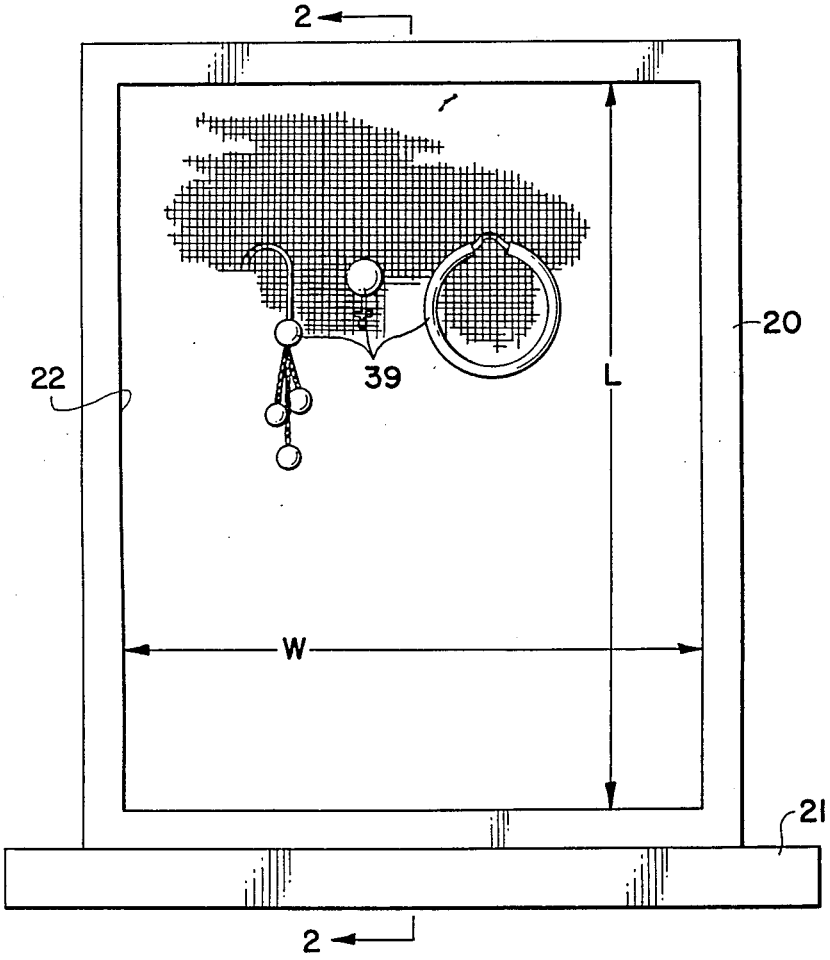
FIG. 1 is a front elevation of one embodiment of this invention.
Figure 2:
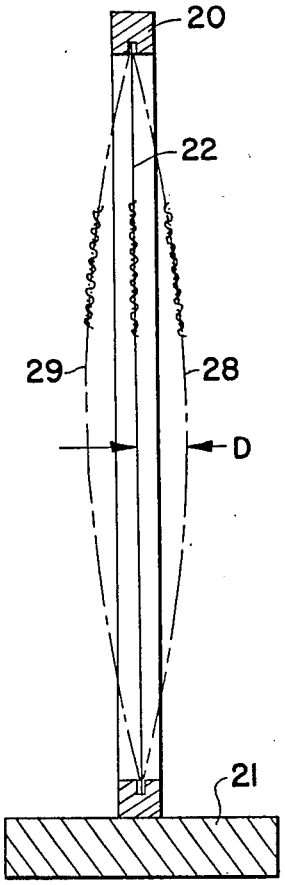
FIG. 2 is a cross sectional view taken at 2—2 of FIG. 1.

The features of this invention are best appreciated by reference to the attached drawings. In FIGS. 1–2 there is shown a simple rectangular frame 20 mounted on a supporting base 21. Frame 20 encloses a central area 22 across which is loosely stretched a fabric having a medium sized mesh generally similar to a screen material. Earrings 39 are hooked, threaded, or otherwise attached to the openings of fabric mesh 22. A particularly preferred material for this purpose is a fiberglass screen. The mesh of the material is characterized by having about 8–16 openings per linear inch. For screen threads of about 0.01 to 0.05 inch the openings will vary from about 0.01 to about 0.1 inch in diameter. Preferably, the openings will have a diameter of about 0.05 to about 0.1 for ease in attaching earrings thereto. It may be seen in the enlarged view of FIG. 3 how the various types of earrings are attached to the weave of screen 22. It is to be noted that the holder of FIGS. 1 and 2 is shown upright but may be positioned horizontally and used as a drawer in a drawer compartment, as would be obvious to those having ordinary skill in the art.

The principal feature of this invention is to attach the fabric 22 to the frame 20 in a loose manner so as to make it easy for the user to attach an earring. The looseness of the fabric is with respect to how it is stretched on frame 20, not the looseness of the weave of the fabric. The weave should be relatively inflexible and untwistable. The looseness of concern here is defined by a deflection D measured in the middle of the longest span L of fabric from one side of the frame to another. In FIG. 1 the frame has a length L and a width W which defines an enclosed area. The sag or deflection D of the fabric in the middle of span L can be expressed as a proportion of D:L in linear dimensions, e.g., inches or centimeters. The proportion of D:L should be from about 1:10 to about 1:40, preferably, 1:15 to 1:25. Deflection D is measured by placing frame 20 horizontally and allowing fabric 22 to sag by reason of gravity, and be measured under those conditions. Obviously, fabric 22 must be flexible like cloth and not stiff like metal wire. Another method of measuring deflection D is simply to push fabric 22 from one side until the limit is reached at 28 on one side or 29 on the other side without placing fabric 22 under any measurable stress. In the range where D:L is 1:15 to 1:25 the fabric can easily be manipulated to attach earrings thereto and yet is taut enough to hold the earrings in a display for rapid inspection and selection.

Figure 4:
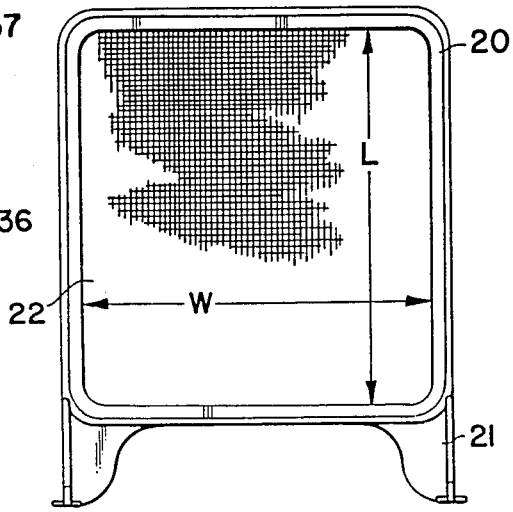
FIG. 4 is a front elevation of a second embodiment of this invention.
Figure 5:
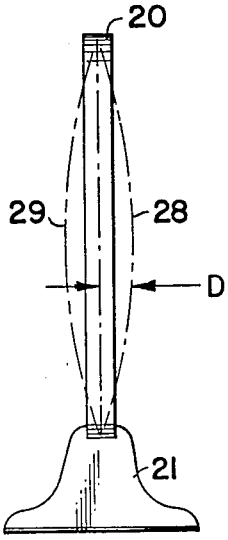
FIG. 5 is a side elevational view of the embodiment of FIG. 4.

In FIGS. 4–5 there is a preferred modernistic design of a plastic frame 20 and base 21 showing how deflection D over span L will position the fabric 22 at either 28 or 29 as the extremes of deflection.

Figure 6:
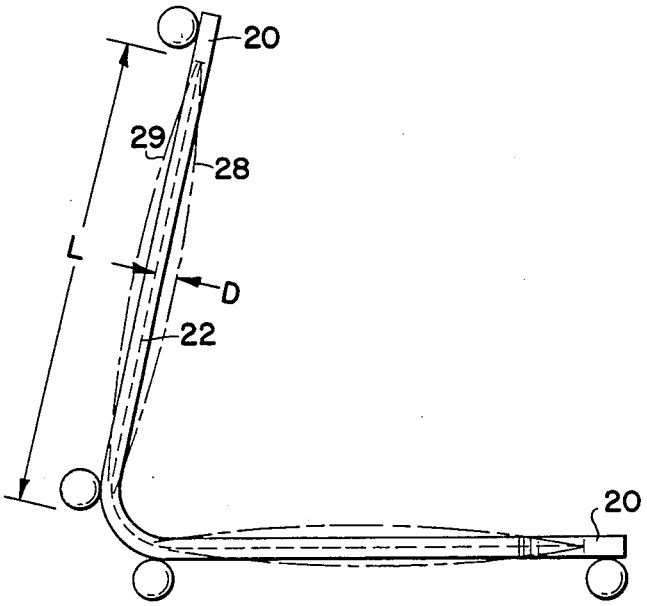
FIG. 6 is a side elevational view of a third embodiment of this invention.
Figure 7:
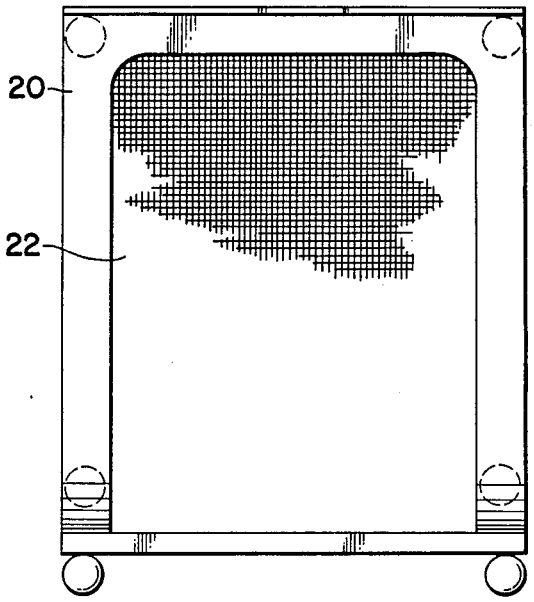
FIG. 7 is a front elevational view of the embodiment of FIG. 6.
Figure 8:
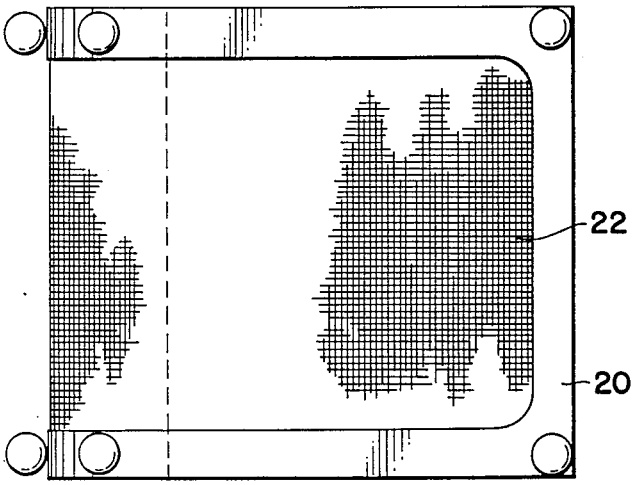
FIG. 8 is a bottom plan view of the embodiment of FIGS. 6–7.

Similarly in FIGS. 6–8 there is an embodiment in which frame 20 is modeled after a picture frame. In this design there are two fabric areas 22 which can be used and the frame 20 can be positioned with either one vertical and the other horizontal. Here again fabric 22 will be loose enough to sag to position 28 or position 29 to provide a deflection D over a span L.

Figure 11:
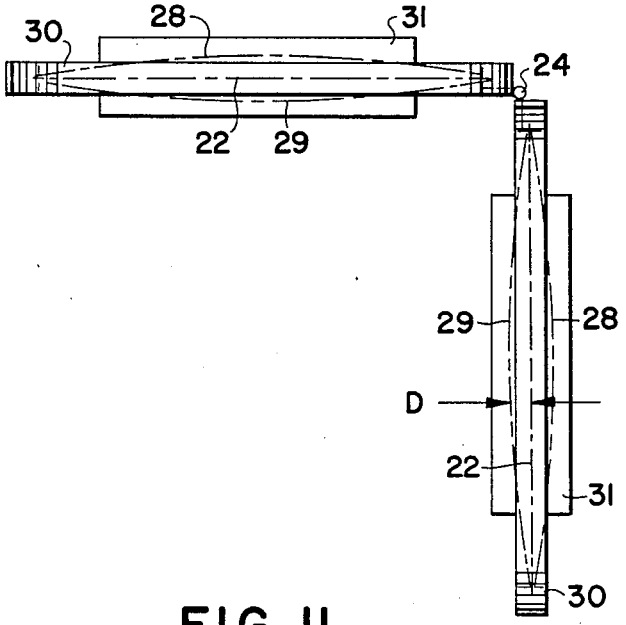
FIG. 11 is a top plan view of the embodiment of FIGS. 9–10.
Figure 9:
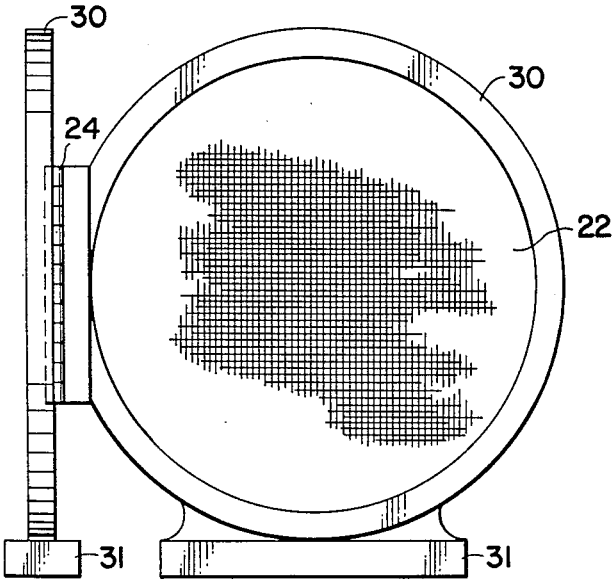
FIG. 9 is a front elevational view of a fourth embodiment of this invention.
Figure 10:
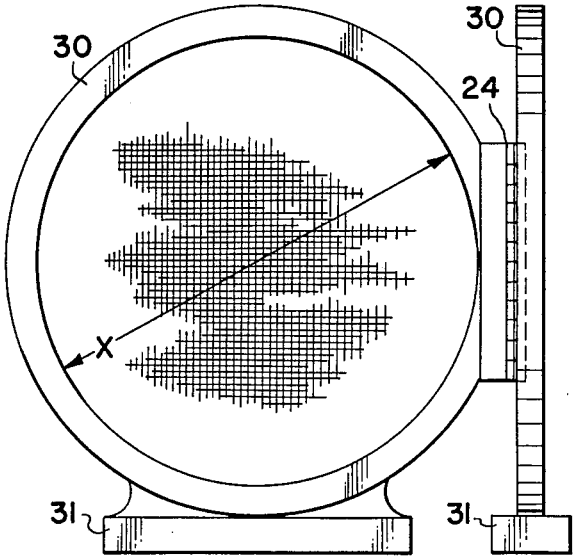
FIG. 10 is a side elevational view of the embodiment of FIG. 9.

In FIGS. 9–11 there is a folding circular frame 30 of two identical sections pivoting about hinge 24. Each section has a fabric screen material 22 which can be deflected a distance D to position 28 or 29. In this case the span of fabric 22 is X, the diameter of frame 30.

Figure 13:
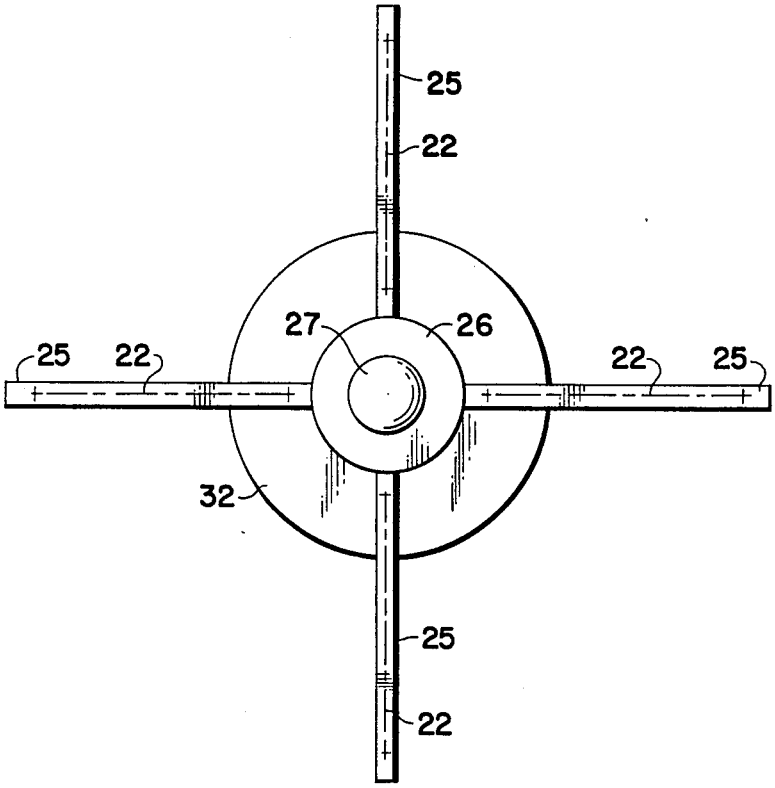
FIG. 13 is a top plan view of the embodiment of FIG. 12.
Figure 12:
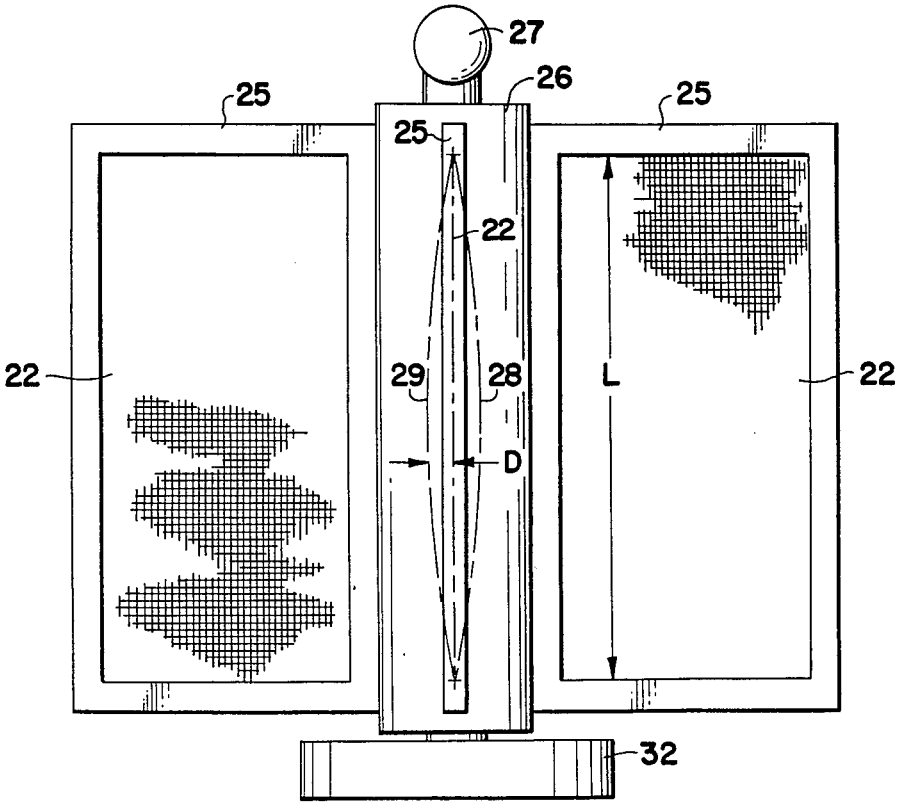
FIG. 12 is a front elevational view of a fifth embodiment of this invention.

In FIGS. 12–13 there is shown a rotatable device of four frames 25 attached to a central support 26 which rotates about its vertical axis by hand manipulation of selective means in the form of a knob 27. The entire structure rests on base 32. Each separate frame 25 contains a fabric screen 22 which is mounted loosely enough for fabric screen to be deflected an amount D over span L to either position 28 or position 29.

It should be appreciated that there is no inventive feature intended for the design of frame 20, 25 or 30 in the various embodiments of this invention. The critical feature is the loose mounting of screen fabric 22 such that the fabric 22 will accept and hold earrings 39 and that the earrings 39 are easily mounted on or removed from fabric 22. If the fabric is too loose the earrings 39 will not be properly held in place for easy selection; and if the fabric is too tight the earrings 39 are not easily attached to or removed from the fabric 22. A maximum range of D:L or D:X is 1:10 to 1:40 while the preferred range is 1:15 to 1:25.

The mesh size of fabric 22 is also important, but only to the extent that the mesh openings are large enough to permit earrings 39 to be easily attached thereto; and yet small enough not to permit earrings 39 from falling off. The preferred mesh is about 8–16 openings per inch, with openings sizes of 0.01 to 0.10 inch, preferably 0.05 to 0.10 inch.

Figure 3:
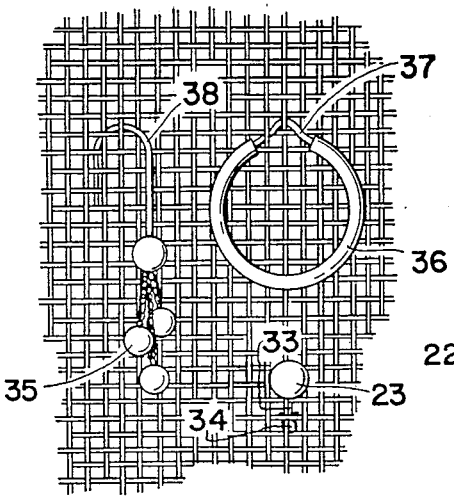
FIG. 3 is an enlarged view of an earring fastened to the holder of FIG 1.

In FIG. 3 there is an enlarged view of three types of earrings attached to fabric 22. Earring 23 is the type having a post 33 to pass through pierced ears and a back 34 to attach to the post 33 and keep earrings 23 from falling off the ear. This type of earring is attached by pushing post 33 through a mesh opening in fabric 22 and attaching back 34 to post 33. Earring 35 has a hook 38 for a pierced ear with no further device for holding it to the ear. Hook 38 is attached to fabric 22 by merely pushing hook 38 through a mesh opening and allowing earring 35 to hang by gravity. Earring 36 is a complete loop with loop end 37 openable or closeable by the spring action of loop end 37. When loop end 37 is open it may be threaded through two or three mesh openings of fabric 22 and then closed in the normal way.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An earring holder adapted for holding stud, hoop and hook type of earrings comprising an open frame having a central aream a fiberglass flexible screen material loosely attached to said frame over said central area, said screen material having mesh openings larger than a stud, hoop or hook of an earring to be easily inserted therethrough without friction therebetween, said screen material overlying said central area in a generally loose condition with an edge of said screen adjacent said frame forming a central plane, said screen having a maximum dimension X, said screen at its center sagging naturally to a deflection D measured perpendicular to said plane, the porportion of D:X being 1:10 to 1:40, said screen being adapted to permit insertion of a hoop of an earring from one side of and through one opening of said material and easily back through an adjacent opening of said material without friction between a hoop and said screen material to positively detachably affix a hoop earring thereto.

2. The holder of claim 1 wherein said mesh size is about 8–16 openings per linear inch.

3. The holder of claim 1 wherein each said mesh opening has a maximum dimension of about 0.01 to 0.10 inch.

4. The holder of claim 1 wherein said proportion of D:X is 1:15 to 1:25.

5. The holder of claim 1 further comprising a standard, and means for attaching said frame to said standard.

6. The holder of claim 5 wherein said standard is adapted for support on a generally horizontal plane, said frame being positioned generally vertically with respect to said plane.

7. The holder of claim 5 wherein said frame is inclined rearwardly toward said standard.

8. The holder of claim 5 wherein said means includes a hinge for connecting said frame to said standard.

9. The holder of claim 5 wherein said standard includes a substantially identical frame and screen material to said frame and screen material thereby affording substantially twice the capacity of receiving and retaining earring thereon.

10. The holder of claim 1 wherein said holder frame is positionable horizontally and adapted for use as a drawer in a drawer compartment.

11. The holder of claim 1 further comprising at least one other frame and screen material identical to said frame and screen material, a standard, means for attaching said border and said other border in spaced relationship to said standard.

12. The holder of claim 11 wherein said means includes selective means for moving said border and other border with respect to said standard.

* * * * *